US011454389B1

(12) United States Patent
Ryznic et al.

(10) Patent No.: US 11,454,389 B1
(45) Date of Patent: Sep. 27, 2022

(54) COMBINATION RECESSED LIGHTING AND SMOKE DETECTOR

(71) Applicants: Brian A Ryznic, Freeport, FL (US); John E Ryznic, West Melbourne, FL (US)

(72) Inventors: Brian A Ryznic, Freeport, FL (US); John E Ryznic, West Melbourne, FL (US)

( * ) Notice: Subject to any disclaimer, the term of this patent is extended or adjusted under 35 U.S.C. 154(b) by 0 days.

(21) Appl. No.: 17/354,661

(22) Filed: Jun. 22, 2021

(51) Int. Cl.
*F21V 33/00* (2006.01)
*G08B 17/113* (2006.01)
*F21S 8/02* (2006.01)

(52) U.S. Cl.
CPC ..... *F21V 33/0076* (2013.01); *F21S 8/026* (2013.01); *G08B 17/113* (2013.01)

(58) Field of Classification Search
CPC ..... F21V 33/0076; F21S 8/026; G08B 17/113
See application file for complete search history.

(56) References Cited

U.S. PATENT DOCUMENTS 4,694,285 A * 9/1987 Scripps ..... G08B 17/00 340/693.11
4,717,910 A * 1/1988 Scripps ..... F21V 33/0076 340/693.11
4,901,056 A * 2/1990 Bellavia ..... G08B 29/145 340/630
5,333,418 A * 8/1994 Chambers ..... G08B 17/113 52/27
6,172,612 B1 * 1/2001 Odachowski ..... G08B 17/00 340/584
7,701,355 B1 * 4/2010 Billman ..... G08B 7/066 340/627
7,969,321 B2 * 6/2011 Spellman ..... G08B 17/113 340/693.11
9,747,763 B1 * 8/2017 Scordato ..... G08B 17/10
2008/0210839 A1 * 9/2008 Klapp ..... G08B 17/113 248/343
2010/0321212 A1 * 12/2010 Bell ..... G08B 17/10 340/945
2012/0268281 A1 * 10/2012 Hojmose ..... G08B 17/113 340/630
2018/0018866 A1 * 1/2018 Carlin ..... G08B 25/008
2019/0080580 A1 * 3/2019 Orr ..... G08B 29/183
2020/0402381 A1 * 12/2020 Nelson ..... G08B 5/00

FOREIGN PATENT DOCUMENTS

EP 2395489 A2 * 12/2011 ..... G08B 17/107
GB 2438444 A * 11/2007 ..... G08B 17/10
GB 2489039 A * 9/2012 ..... F21S 8/026
WO WO-2011042020 A1 * 4/2011 ..... F21V 33/0076

* cited by examiner

*Primary Examiner* — Chico A Foxx
(74) *Attorney, Agent, or Firm* — John Ryznic

(57) ABSTRACT

The embodiments provide a system and an apparatus for a combination of a recessed lighting and a smoke detector. A room can include several recessed lights in which one of the recessed lights will include an integral smoke detector that is hidden behind the recessed light. The recess light includes a smoke collecting chamber with several smoke holes to guide any smoke from the room toward the smoke detector. A wall mounted smoke detector testing device can be connected to the smoke detector by a wire in which a person in the room can test the smoke detector without the need to access the smoke detector located above the recessed light.

11 Claims, 6 Drawing Sheets

COMBINATION RECESSED LIGHTING AND SMOKE DETECTOR

The present application claims the benefit to a provisional application No. 63/014,262 filed on Apr. 23, 2020 and entitled RECESSED LIGHTING WITH INTEGRAL SMOKE DETECTOR.

TECHNICAL FIELD

The present disclosure generally relates to recessed lighting, and in particular to a recessed lighting with a smoke detector.

BACKGROUND

Recessed lighting fixtures are a source of light mounted in a ceiling in which the light face is flush with the ceiling surface to appear as one smooth surface. Recessed lighting can be circular or rectangular in shape as it appears in the ceiling surface. Recessed lighting is typically an LED light in order to form the light fixture as thin as possible.

A smoke detector is required to be installed in all rooms of a house or rental in which people sleep to awaken any sleeping person to the detection of smoke in the room indicating a fire. A smoke detector typically has a mounting surface that is secured to a ceiling surface and a detector body that extends out from the mounting surface such that the smoke detector sticks out from the flat ceiling surface. Many homeowners consider this structure to be ugly especially when recessed lighting is used in the room. FIG. 1 shows an embodiment with an arrangement of recessed lighting 104 arranged in a rectangular array on a ceiling 102. Various arrangements of recessed lighting can be formed. A smoke detector 106 is also mounted to the ceiling 102 but is not recessed as is the lighting 104. The smoke detector is a different device than the recessed lighting and can extend outward from the ceiling surface. This is not a desired appearance to a home owner that uses a symmetrical arrangement of recessed lighting.

There is a need in the art for a system and method that addresses the shortcomings discussed above.

SUMMARY

In one aspect, a device can have a recessed lighting with an integral smoke detector. The smoke detector is hidden behind the recessed lighting so it can be not visible from a view looking at the ceiling. The recessed lighting with smoke detector will look like the other recessed lighting that do not have a smoke detector.

In another aspect, a system for testing a recessed light with a smoke detector can have a wall mounted device connected to the smoke detector by a wire for testing the smoke detector. The wall mounted device can include a backup battery and a switch or button that can be flipped or pushed to test the smoke detector from the floor.

In another aspect, the smoke detector can include a backup battery and a wall mounted device can be connected by a wire to the smoke detector for testing of the smoke detector.

In another aspect, two or more of the smoke detectors in a building can be hard wired together so that all smoke detectors can be tested from one wall mounted device with a testing switch or push button.

In another aspect, a wall mounted testing device can be wirelessly connected to a smoke detector for testing. Both the smoke detector and the wall mounted device can have a backup battery to test the smoke detector if the main source of electrical power is out.

Other systems, methods, features, and advantages of the disclosure will be, or will become, apparent to one of ordinary skill in the art upon examination of the following figures and detailed description. It is intended that all such additional systems, methods, features, and advantages be included within this description and this summary, be within the scope of the disclosure, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments provide a recessed lighting array in which one recessed light includes a smoke detector that looks like the other recessed lights that do not include a smoke detector.

Figure 1:
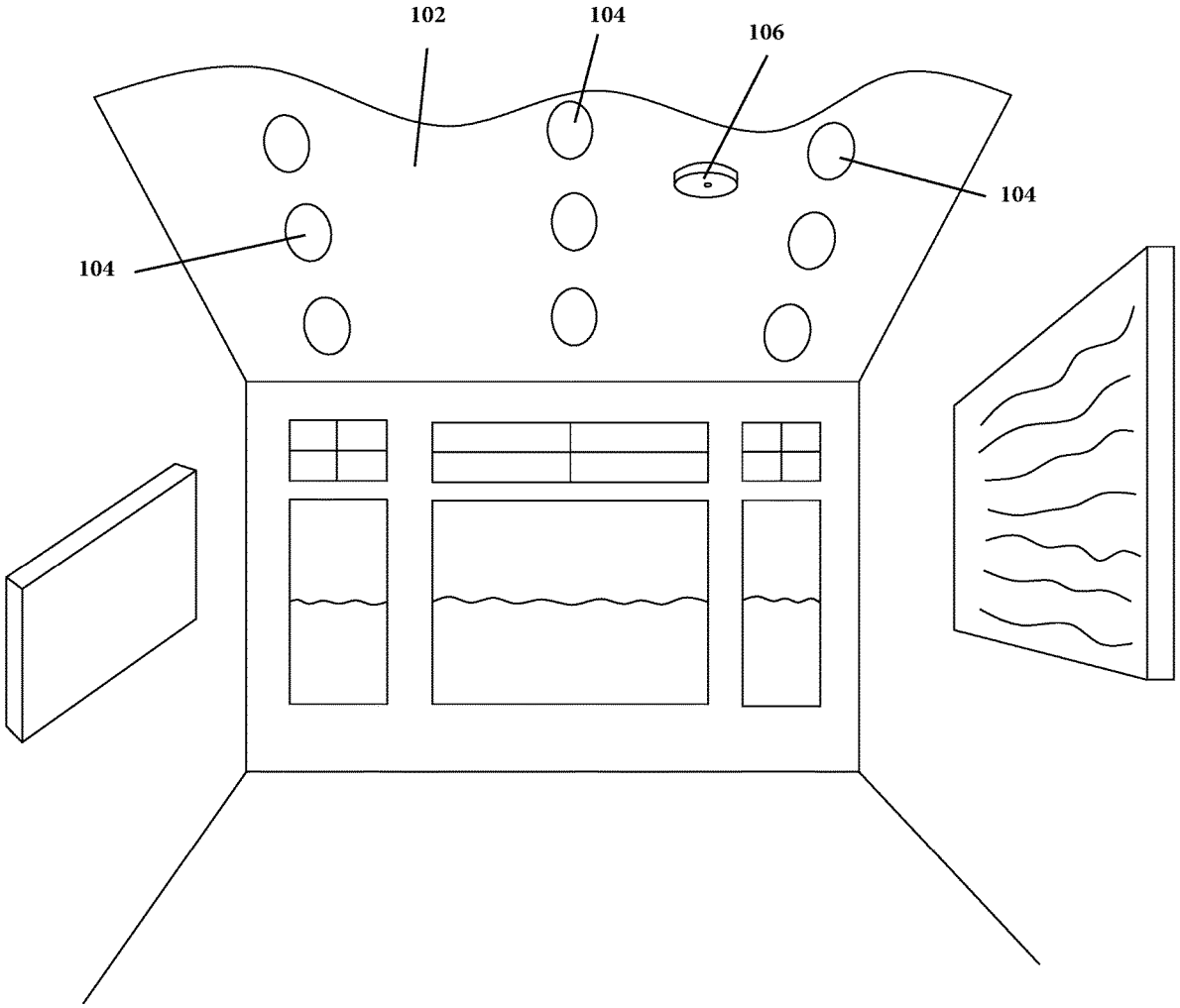
FIG. 1 is a schematic view of a room with a ceiling having an array of recessed lights mounted flush to the ceiling surface and a separate smoke detector, according to an embodiment.
Figure 2:
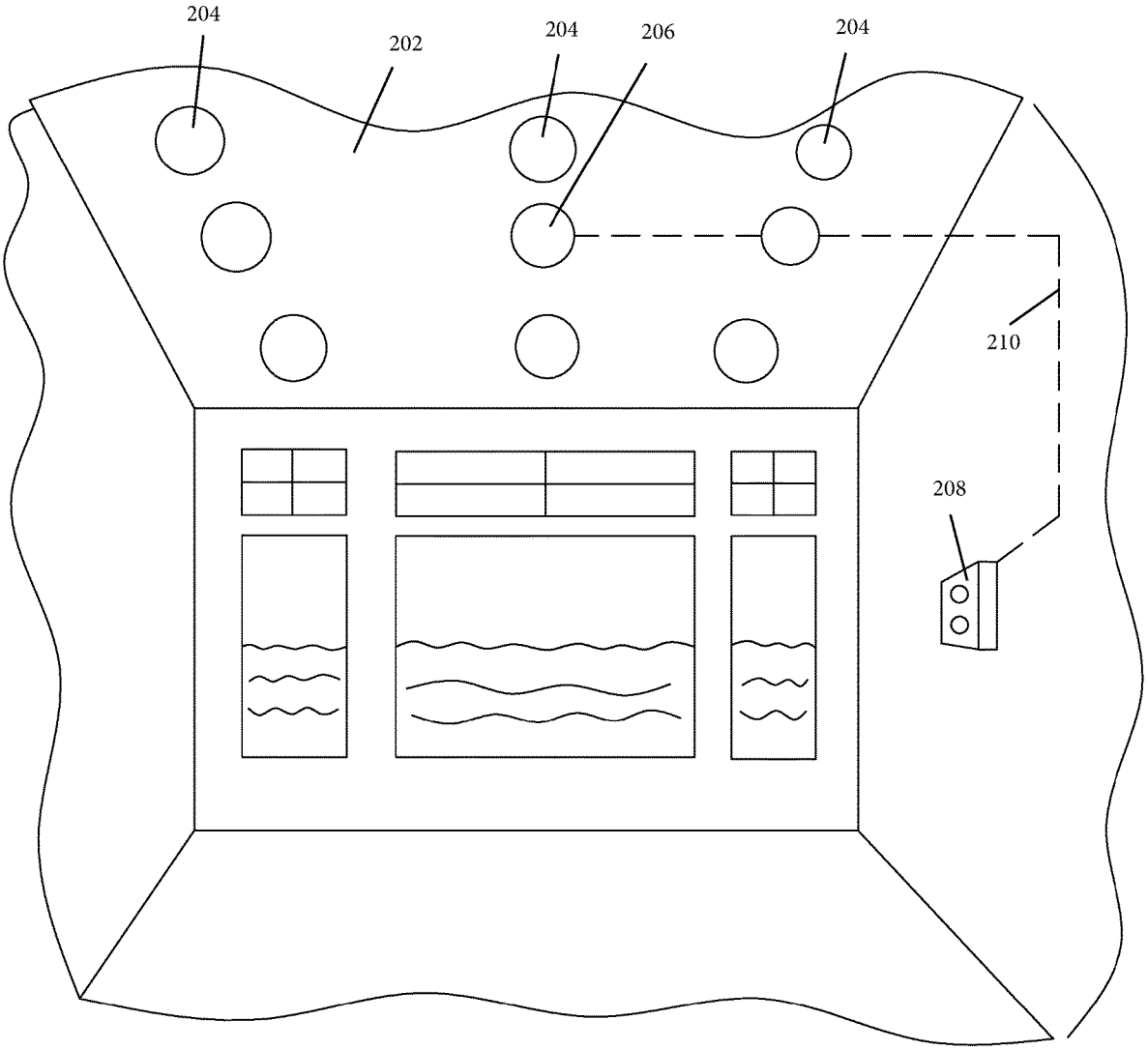
FIG. 2 is a schematic view of a room with a ceiling 202 having an array of recessed lights with one of the recessed lights also having a smoke detector, according to an embodiment.

In one aspect, FIG. 2 shows a room with a ceiling 202 in which an array of recessed lights 204 are arranged. In one embodiment, a rectangular array of recessed lights can be used with two rows of recessed lights forming a rectangular array. One of the recessed lights 206 in the array can include a smoke detector. Each of the recessed lights can be circular shaped or rectangular shaped from a front view. Each recessed light is connected to the power grid of the house to power both the light source and the smoke detector. The smoke detector can include a backup battery to supply power to the smoke detector if the power grid of the house goes out.

In one aspect, a wall mounted smoke detector testing device 208 is connected to the smoke detector 206 with a wire hidden from view. The wall mounted smoke detector testing device 208 can include a switch or a push button that can be used to test the smoke detector 206. The smoke detector and the light source of the recessed light are both connected to the electrical grid of the house and thus power both the light source and the smoke detector. The smoke detector can include a backup battery for the case when the electrical power for the house goes out, the backup battery will allow the smoke detector to function. When the switch or push button is activated and the smoke detector is working properly, a device on the smoke detector will make a sound indicating that the smoke detector is working properly. For a tall ceiling with the recessed light and smoke detector 206, a person would need a ladder to reach a test button or switch on a smoke detector. Since the smoke detector is hidden from view by the recessed light, the recessed light and smoke detector would have to be removed from the ceiling to test the smoke detector. In one embodiment, the test switch or button is mounted to the wall in the room so a person can test the smoke detector without having to reach for the ceiling mounted smoke detector. In one embodiment, the smoke detector is hidden from view and a wall mounted device for testing the smoke detector can allow for a person to test the smoke detector without having to remove the recessed light 206 from the ceiling 202.

In one aspect, the wall mounted device 208 can be connected to the smoke detector with a wire hidden from view.

In another aspect, smoke detector testing device 208 can be connected to the smoke detector 206 for testing using a wireless connection. A wireless device like a TV remote control can be used to supply a signal to the smoke detector for testing. If the smoke detector goes off do to smoke appearing, the wireless smoke detector testing device can also be used to turn off the alarm of the smoke detector. If several rooms each having a recessed light with a smoke detector is used, one smoke detector testing device can be used for test or turn off all of the smoke detectors.

Figure 3:
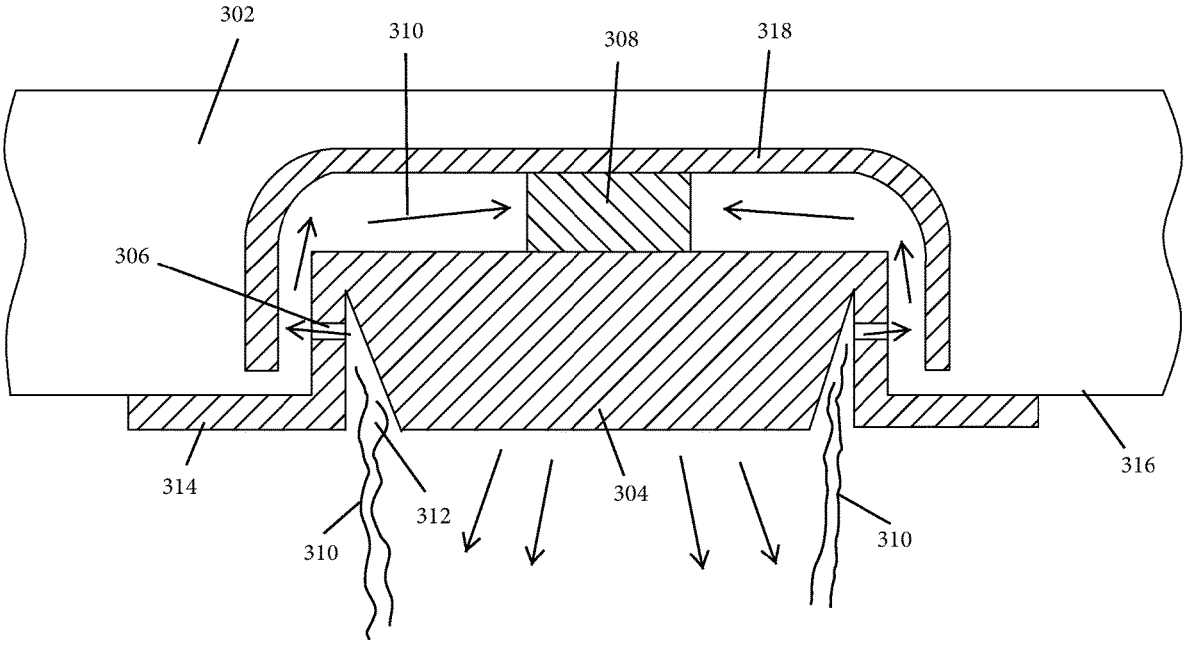
FIG. 3 is a schematic view of a recessed light with a smoke detector from a front view, according to an embodiment.

FIG. 3 shows a recessed light with a smoke detector from a cross sectional side view. The recessed light 304 includes a source of light that can be an LED light. The recessed light can include a mounting extension 314 that can be used to mount the recessed light flush with a ceiling surface 316 of a ceiling 302 in a room. The mounting extension 314 can include a vertical extending section and a horizontally extending section. The mounting extension 314 can form a surface to the recessed light 304 and smoke detector flush with the ceiling surface 316. An annular shaped smoke collecting opening or chamber 312 can be formed between the light source 304 and the mounting extension 314 in which smoke can collect and then pass through several holes 306 formed in the mounting extension 314 and flow to the smoke detector 308. In one embodiment, a smoke guiding plate 318 can be mounted on the smoke detector 308 to direct the smoke from the holes 306 into the smoke detector sensor. In one embodiment, the annular opening 312 can be V-shaped. In another embodiment, the annular opening 312 can be U-shaped. In one embodiment, the smoke detector 308 is located above the recessed light 304. The annular smoke collecting chamber 312 can allow for the smoke to accumulate before passing through one or more holes 306 in the mounting extension 314 on the way to the smoke detector 308.

Figure 4:
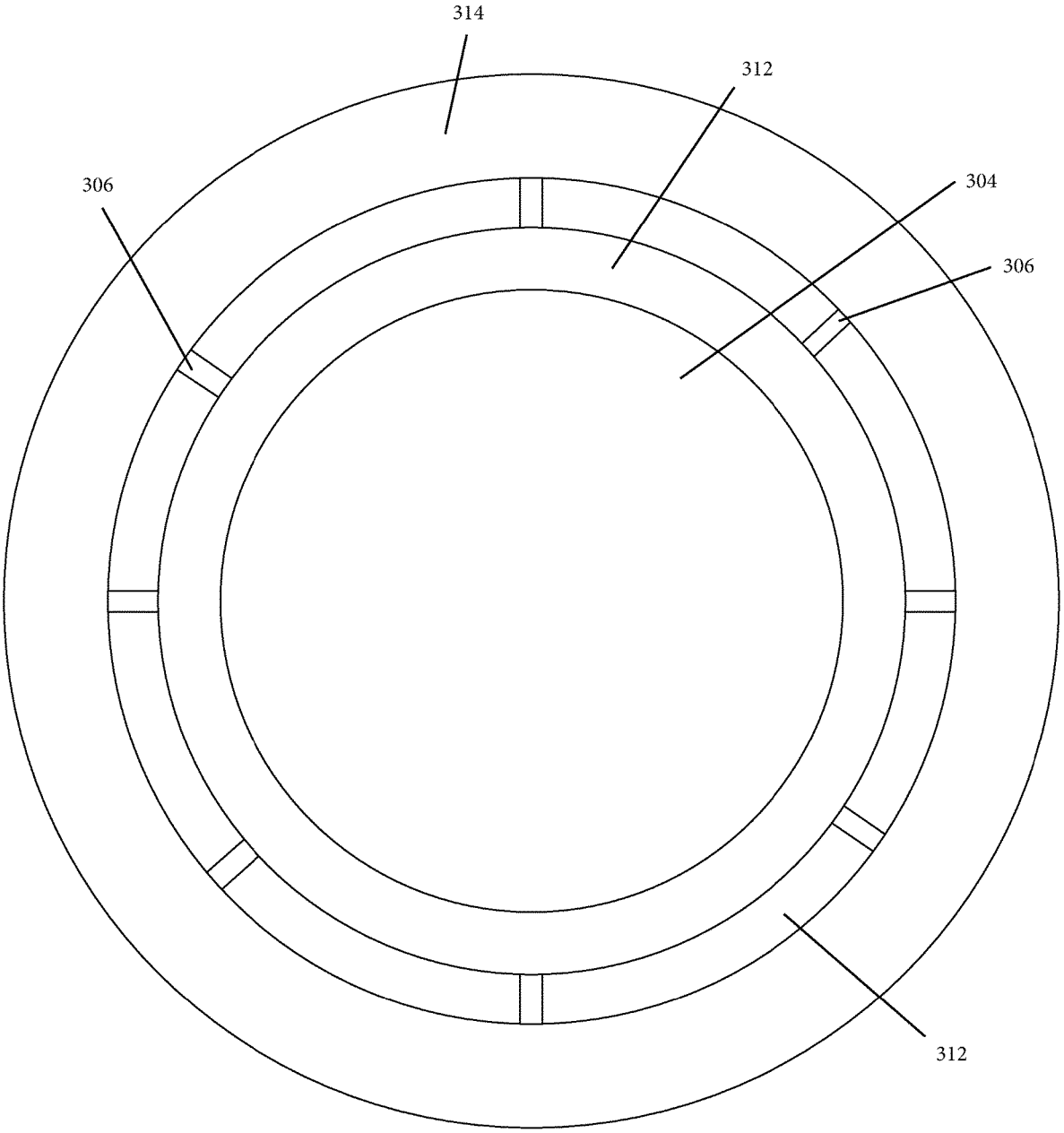
FIG. 4 is a schematic view of a recessed light with a smoke detector from a side view, according to an embodiment.

FIG. 4 shows a cross sectional side view of the recessed light and smoke detector. The light source 304 is inside of the annular smoke collecting chamber 312 which can be inside of the mounting extension 314 having the holes 306. The annular smoke collecting chamber 312 allows for smoke to accumulate before passing through the holes 306 and then to the smoke detector 308.

Figure 5:
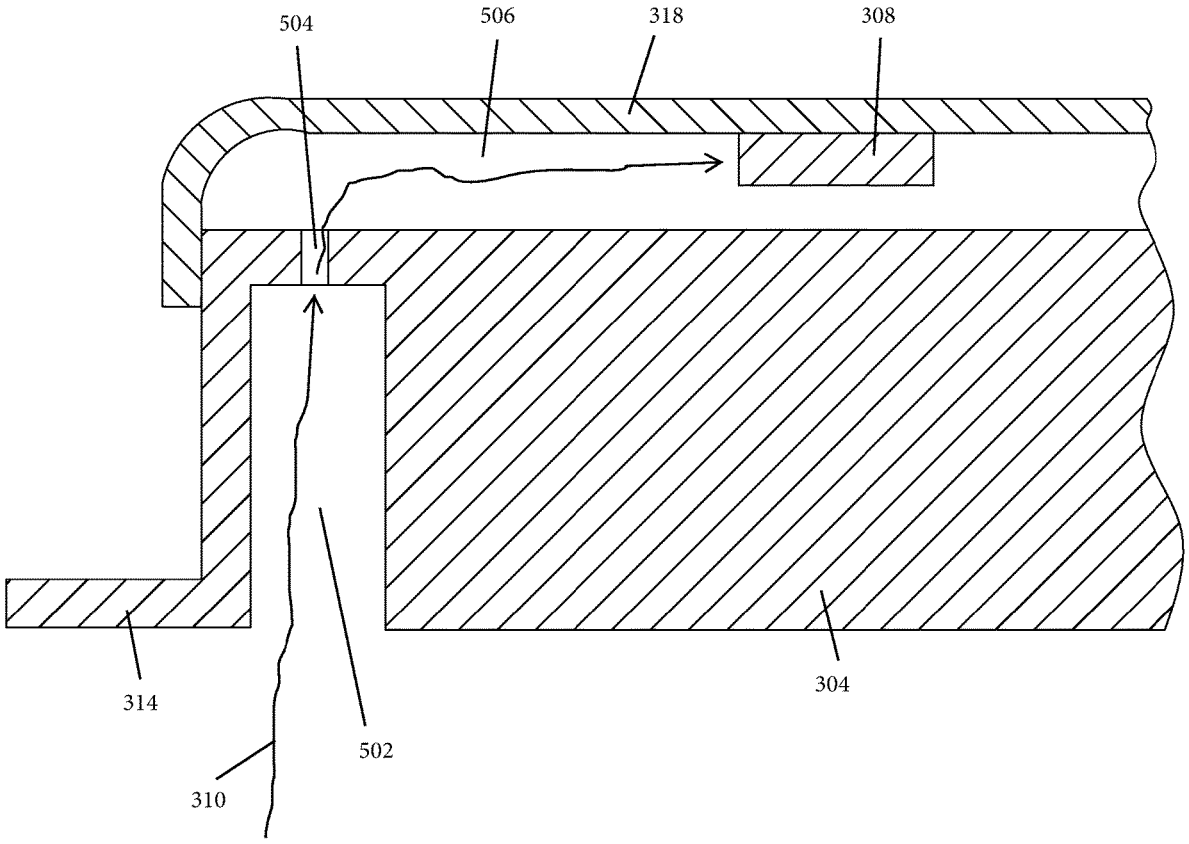
FIG. 5 is a cross sectional schematic view of a rectangular shaped smoke collecting area with a vertical smoke hole.

In one embodiment, a smoke collecting chamber 312 can be rectangular in cross sectional shape like in FIG. 5. The smoke hole 504 can be extending vertically into a smoke guiding channel 506 formed by the smoke guiding plate 318. Smoke 310 from the room will flow up and into the smoke collecting chamber 502 and thru the smoke hole 504 and into the smoke guiding channel 506 to the smoke sensor in the smoke detector 308.

Figure 6:
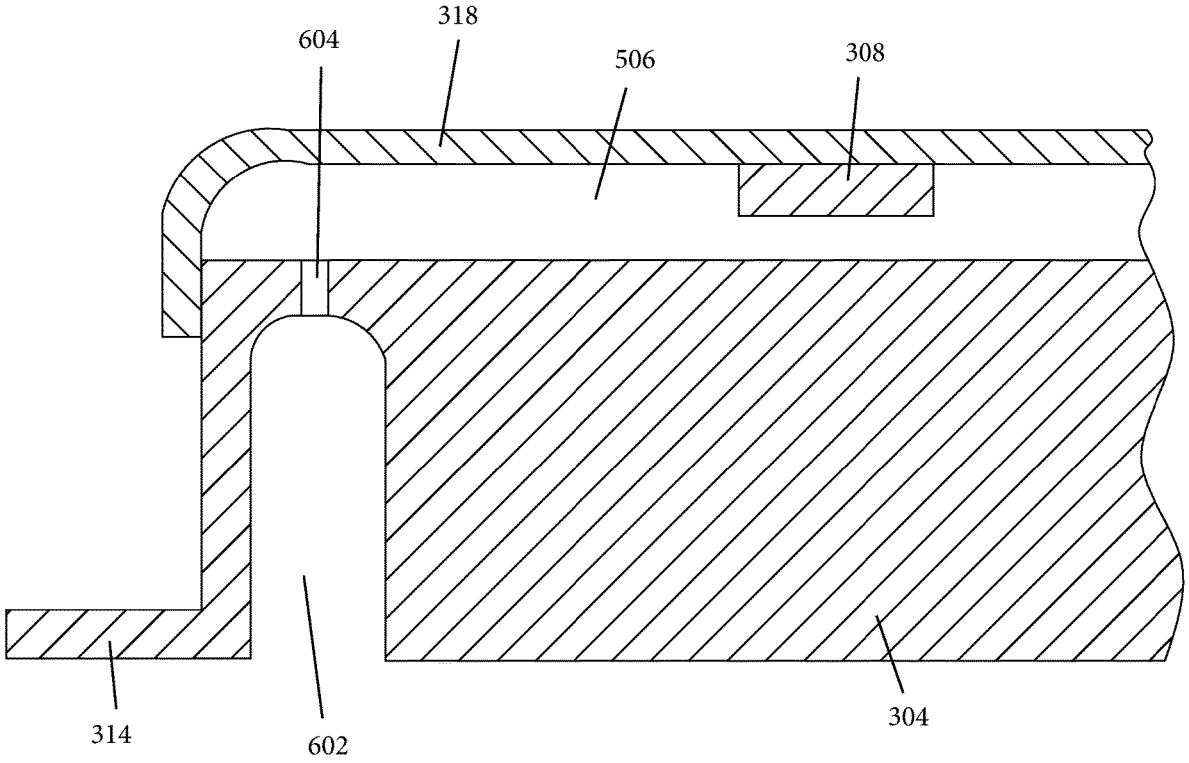
FIG. 6 is a cross sectional schematic view of a curved shaped smoke collecting area with a vertical smoke hole.

In another embodiment, a smoke collecting chamber 602 in FIG. 6 can be rounded on the top with a smoke hole 604 extending from the smoke collecting chamber 602 to the smoke guiding channel 506 under the smoke guiding plate 318 toward the smoke sensor in the smoke detector 308.

In one embodiment, the smoke collecting chamber can be a full annular collecting chamber extending around the outside of the light source of the recessed light. In another embodiment, the smoke collecting chamber can be an opening that does not extend in a full annular way but at a small arc around the light source. In another embodiment with a rectangular shaped light source, the smoke collecting chamber can extend along all four sides of the rectangular shaped light source. In another embodiment, one or more small openings can be the smoke collecting chamber or areas that do not extend along all four sides of the rectangular shaped light source.

The recessed light with the smoke detector can provide for an appealing look for a ceiling with several recessed lights in which one of the recessed lights includes a smoke detector that is hidden from view while looking the same as the recessed lights that do not include a smoke detector. Since all the recessed lights can be illuminated, the appearance can be appealing to a person in the room.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A combination recessed light and a smoke detector comprising:

a recessed light with a light source;

a smoke detector mounted to the recessed light;

a smoke collecting chamber formed outward of the light source;

a smoke hole opening into the smoke collecting chamber;

a smoke guide plate to form a smoke guide channel to channel smoke from the smoke hole to a smoke sensor of the smoke detector; and the smoke guide plate forms a closed smoke guide channel between the recessed light and the smoke detector.

2. A combination recessed light and a smoke detector comprising:

a recessed light with a light source;

a smoke detector mounted to the recessed light;

a smoke collecting chamber formed outward of the light source;

a smoke hole opening into the smoke collecting chamber;

a smoke guide plate to form a smoke guide channel to channel smoke from the smoke hole to a smoke sensor of the smoke detector;

the recessed light is a circular recessed light;

the smoke collecting chamber is an annular shaped smoke collecting chamber; and an annular arrangement of smoke holes connecting the smoke collecting chamber and the smoke guide channel.

3. A system of recessed lighting and a smoke detector for a residential home comprising:

a plurality of recessed lights secured in a ceiling of a room for the residential home;

one of the recessed lights includes an integral smoke detector;

a smoke detector testing device in communication with the smoke detector to test the smoke detector;

the recessed light with the integral smoke detector includes a smoke collecting chamber opening into the room below the recessed light;

the smoke collecting chamber includes a smoke hole;

a smoke guide plate attached to the smoke detector to form a smoke guide channel; and the smoke hole connects the smoke collecting chamber to the smoke guide channel.

4. A system of recessed lighting and a smoke detector for a residential home comprising:

a plurality of recessed lights secured in a ceiling of a room for the residential home, each of the plurality of recessed lights including a light source;

one of the recessed lights includes an integral smoke detector;

a smoke detector testing device in communication with the smoke detector to test the smoke detector; and the integral smoke detector is attached to a top side of the recessed light;

wherein the one of the recessed lights including the integral smoke detector comprises:

a mounting extension located outward of the light source;

the mounting extension including a vertical extending section and a horizontal extending section;

wherein the vertical extending section and the horizontal extending section form a smoke collecting opening between the mounting extension and the light source to enable a smoke sensor of the smoke detector to detect smoke flowing in the residential home.

5. A combination recessed light and smoke detector comprising:

a recessed light with a light source;

a mounting extension on the recessed light located outward of the light source, the mounting extension including a vertical extending section and a horizontal extending section;

a smoke collecting chamber on the recessed light located between the light source and the mounting extension;

wherein the vertical extending section and the horizontal extending section form a smoke collecting opening between the mounting extension and the light source;

a smoke guiding channel located above the recessed light;

a smoke detector located in the smoke guiding channel; and a smoke hole with an inlet opening into the smoke collecting chamber and an outlet opening into the smoke guiding channel, the smoke hole located within the smoke collecting opening;

wherein smoke from below the recessed light flows into the smoke collecting chamber, thru the smoke hole, and into the smoke guiding channel to the smoke detector.

6. The combination recessed light and smoke detector of claim 5, and further comprising:

the smoke collecting chamber is an annular chamber.

7. The combination recessed light and smoke detector of claim 5, and further comprising:

a guide plate is mounted on a top side of the recessed light and forms the smoke guiding channel.

8. The combination recessed light and smoke detector of claim 5, and further comprising:

the recessed light is a wafer recessed light.

9. A combination recessed light and a smoke detector comprising:

a wafer recessed light with an LED light source;

the wafer recessed light having a mounting extension outward from the LED light source, the mounting extension having a horizontal surface to position the wafer recessed light within an opening of a ceiling and a vertical surface to form a smoke collecting opening between the mounting extension and the LED light source;

a smoke guide plate mounted to a top side of the wafer recessed light;

a smoke detector located within a channel formed by the smoke guide plate and the wafer recessed light; and a path within the smoke collecting opening for smoke to flow from a location below the wafer recessed light to enable smoke detection by a smoke sensor of the smoke detector.

10. The combination recessed light and smoke detector of claim 9, and further comprising:

the path for smoke includes a smoke collecting chamber formed between the LED light source and the mounting extension; and a smoke hole connecting the smoke collecting chamber to the smoke detector.

11. The combination recessed light and smoke detector of claim 10, and further comprising:

the smoke collecting chamber is an annular chamber.

* * * * *